US011359459B2

(12) United States Patent
Davies et al.

(10) Patent No.: US 11,359,459 B2
(45) Date of Patent: Jun. 14, 2022

(54) REMOTE CLOSING AND OPENING OF A BARRIER VALVE

(71) Applicant: Halliburton Energy Services, Inc., Houston, TX (US)

(72) Inventors: Katherine Ann Davies, Tayside (GB); Peter D W Inglis, Tayside (GB)

(73) Assignee: Halliburton Energy Services, Inc., Houston, TX (US)

( * ) Notice: Subject to any disclaimer, the term of this patent is extended or adjusted under 35 U.S.C. 154(b) by 45 days.

(21) Appl. No.: 16/637,641

(22) PCT Filed: May 14, 2019

(86) PCT No.: PCT/US2019/032270
§ 371 (c)(1),
(2) Date: Feb. 7, 2020

(87) PCT Pub. No.: WO2020/231415
PCT Pub. Date: Nov. 19, 2020

(65) Prior Publication Data
US 2021/0172288 A1 Jun. 10, 2021

(51) Int. Cl.
*E21B 34/14* (2006.01)

(52) U.S. Cl.
CPC ..... *E21B 34/142* (2020.05)

(58) Field of Classification Search
CPC ..... E21B 34/14; E21B 34/142
See application file for complete search history.

(56) References Cited

U.S. PATENT DOCUMENTS 3,886,967 A * 6/1975 Nelson ..... E21B 34/102 137/495
6,152,229 A * 11/2000 Jennings ..... E21B 29/04 166/321
8,534,317 B2 9/2013 Plunkett et al.
2006/0169462 A1* 8/2006 Bishop ..... E21B 41/00 166/383
2008/0223581 A1 9/2008 Beall et al.
2009/0184278 A1* 7/2009 Beall ..... E21B 34/14 251/315.1
2010/0084138 A1* 4/2010 Inglis ..... E21B 34/14 166/373
2012/0018172 A1* 1/2012 Javed ..... E21B 43/10 166/382
2012/0085542 A1 4/2012 Hayter et al.
2013/0199795 A1* 8/2013 Williamson ..... E21B 47/00 166/373
2014/0290960 A1 10/2014 Stewart

OTHER PUBLICATIONS

International Search Report and Written Opinion for Application No. PCT/US2019/032270, dated Feb. 13, 2020.

* cited by examiner

*Primary Examiner* — Christopher J Sebesta
(74) *Attorney, Agent, or Firm* — Scott Richardson; C. Tumey Law Group PLLC

(57) ABSTRACT

A system and method for opening and closing a barrier valve. The system may comprise a plurality of production tubing sections, a barrier valve, and an actuation module attached to the barrier valve. The method may comprise attaching an actuation module to one of one or more production tubing sections, disposing the actuation module, the barrier valve, and the one or more production tubing sections into an annulus, moving the mandrel with the first piston or the second piston, and moving a ball within the barrier valve to a closed position.

20 Claims, 3 Drawing Sheets

REMOTE CLOSING AND OPENING OF A BARRIER VALVE

BACKGROUND

For oil and gas exploration and production, a network of wells, installations and other conduits may be established by connecting sections of metal pipe together. For example, a well installation may be completed, in part, by lowering multiple sections of metal pipe (i.e., a casing string) into a wellbore, and cementing the casing string in place. In some well installations, multiple casing strings are employed (e.g., a concentric multi-string arrangement) to allow for different operations related to well completion, production, or enhanced oil recovery (EOR) options.

During production operations, different tools may be disposed downhole on production tubing to control the flow of desirable fluids from a formation. In examples, downhole tools may have valves that actuate using pistons. Currently, these pistons may be hydraulically operated with hydraulic lines that may stretch from the surface to the downhole tool disposed in a formation. Due to the extreme nature experienced downhole, hydraulic lines may be susceptible to failure and may not operate correctly. Additionally, each line may take up valuable space within a wellbore, which may limit the number of tools an operator may dispose downhole

BRIEF DESCRIPTION OF THE DRAWINGS

These drawings illustrate certain aspects of some examples of the present disclosure and should not be used to limit or define the disclosure.

DETAILED DESCRIPTION

Systems and methods discussed below may be directed to a downhole device that may operate and/or function from pressure applied to an annulus of a wellbore. Specifically, a downhole device sensitive to pressure cycles, which may allow the downhole device to function during operations at specified times.

Figure 1:
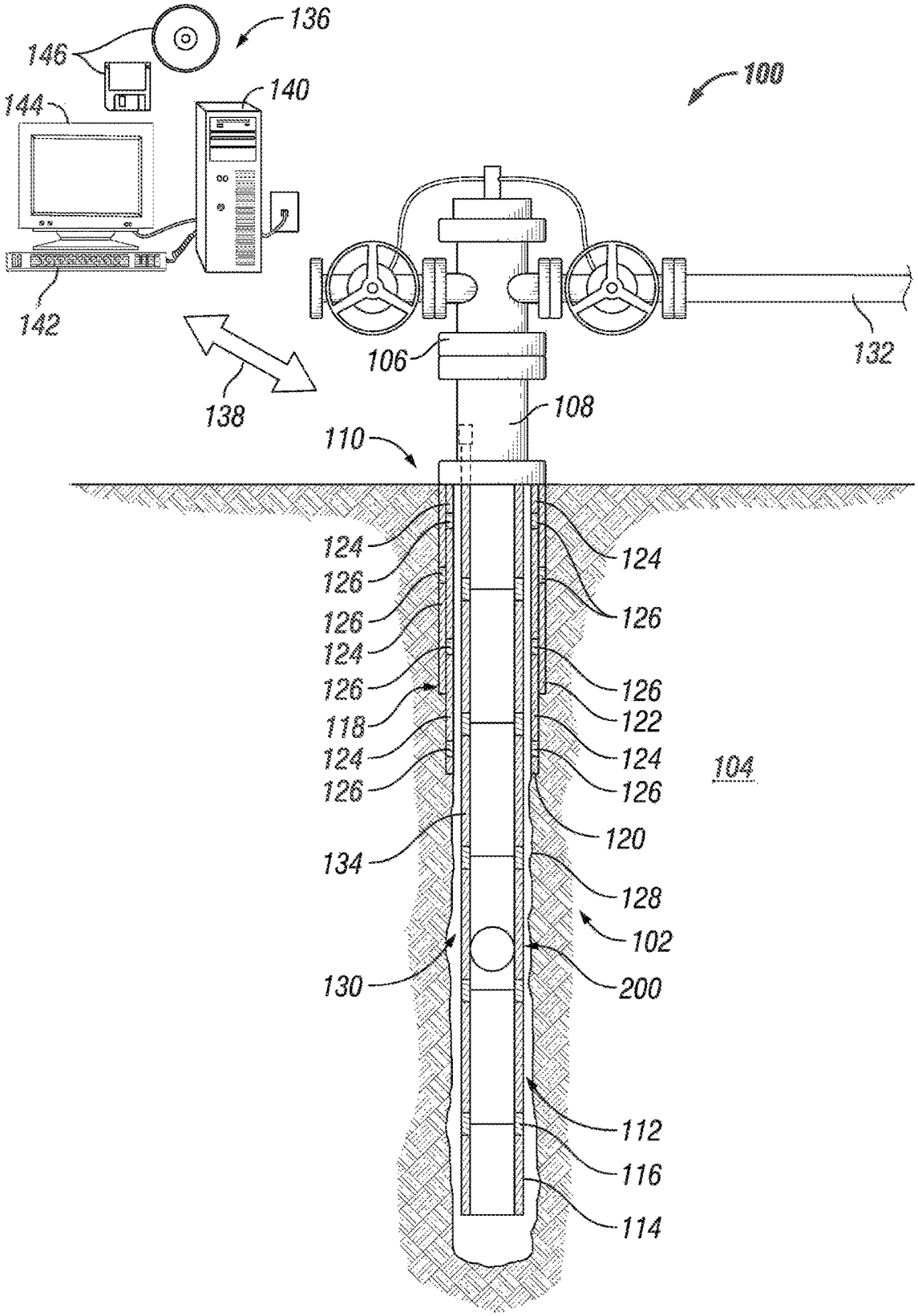
FIG. 1 illustrates a production fluid recovery system.

FIG. 1 illustrates a production fluid recovery system 100 disposed in a wellbore 102. Production fluid recovery system 100 may include a wellbore 102 formed within a formation 104. Wellbore 102 may be a vertical wellbore as illustrated or it may be a horizontal and/or a directional well. While production fluid recovery system 100 may be illustrated as land-based, it should be understood that the present techniques may also be applicable in offshore applications. Formation 104 may be made up of several geological layers and include one or more hydrocarbon reservoirs. As illustrated, production fluid recovery system 100 may include a production tree 106 and a wellhead 108 located at a well site 110. Production tubing 112 or a plurality of production tubing 112 may be coupled to production tree 106 and extend from wellhead 108 into wellbore 102, which may traverse formation 104. In examples, production tubing 112 may include a plurality of production segments 114 attached at production collars 116. It should be noted that production tubing 112 may be rigid pipe sections or any type of coiled tubing.

In examples, wellbore 102 may be cased with casing string 118. As illustrated, casing string 118 may include a first casing 120 and a second casing 122. However, casing string 118 may include any suitable number of casings. Each casing may include one or more casing segments 124. Casing segments 124 help maintain the structure of wellbore 102 and prevent wellbore 102 from collapsing in on itself. As illustrated, production tubing 112 may be positioned inside of casing string 122 extending part of the distance down wellbore 102. Production tubing 112 may include concentric pipes formed from casing segments 124, which may be attached to each other by collars 126. In some examples, a portion of the well may not be cased and may be referred to as "open hole." The space between production tubing 112 and casing segments 124 or wellbore wall 128 may be an annulus 130. Production fluid may enter annulus 130 from formation 104 and then may enter production tubing 112 from annulus 130. Production tubing 112 may carry production fluid uphole to production tree 106. Production fluid may then be delivered to various surface facilities for processing via a surface pipeline 132.

The flow of production fluid through production tubing 112 may be controlled by barrier valve 200, further discussed below. During operation, barrier valve 200 may function in an "open" state or a "closed" state. The "open" state allows for the movement of production fluid through production tubing 112 and the "closed" state prevents the movement of production fluid through production tubing 112. Without limitation, actuation module 134 may be attached to barrier valve 200 and may function to control the opening or closing of barrier valve 200.

As discussed below, an actuation module 134 may be disposed in production tubing 112. In examples, actuation module 134 may work within production fluid recovery system 100 to control flow of production fluid within production tubing 112. Additionally, actuation module 134 may operate with a plurality of actuation modules 134 to segment wellbore 102 into different identified areas. Currently, actuation module 134 may operate through the use of hydraulic lines (not illustrated) connected to actuation module 134. These hydraulic lines may be controlled by an information handling system 136 through communication line 138. Communication line 138 may be any suitable wire communications and/or wireless communications.

Information handling system 136 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, information handling system 136 may be a personal computer 140, a network storage device, or any other suitable device and may vary in size, shape, performance, functionality, and price. Information handling system 136 may include random access memory (RAM), one or more processing resources such as a central processing unit (CPU) or hardware or software control logic, ROM, and/or other types of nonvolatile memory. Additional components of information handling system 136 may include one or more disk drives, one or more network ports for communication with external devices as well as various input and output (I/O) devices, such as a keyboard 142, a mouse, and a video display 144. Information handling system 136 may also include one or more buses operable to transmit communications between the various hardware components.

Alternatively, systems and methods of the present disclosure may be implemented, at least in part, with non-transitory computer-readable media. Non-transitory computer-readable media may include any instrumentality or aggregation of instrumentalities that may retain data and/or instructions for a period of time. Non-transitory computer-readable media may include, for example, without limitation, storage media such as a direct access storage device 146 (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Figure 3:
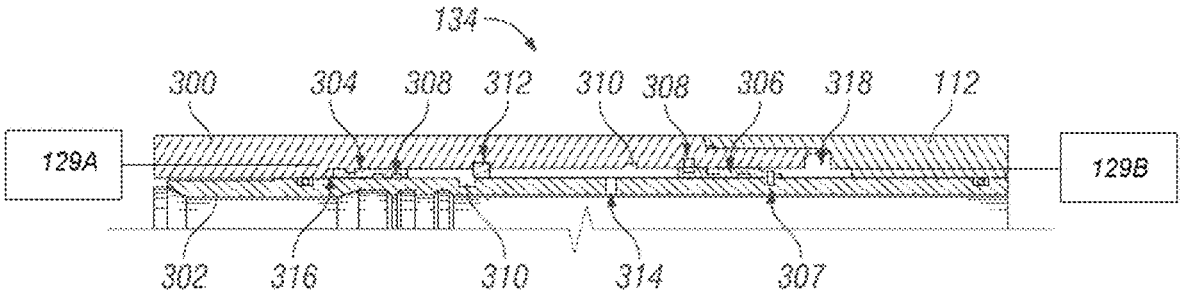
FIG. 3 illustrates an actuation module in a starting position.
Figure 4:
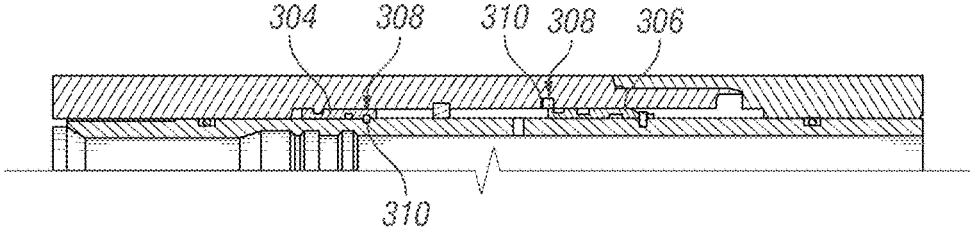
FIG. 4 illustrates the actuation module in a closed position.
Figure 5:
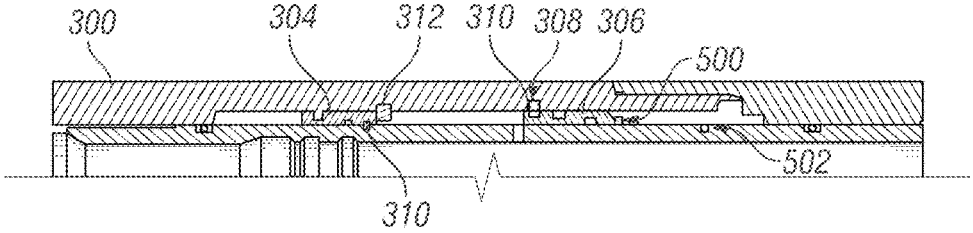
FIG. 5 illustrates the actuation module in an open position.

As mentioned above, current technology may control actuation module 134 through a direct hydraulic connection, which may be controlled by information handling system 136. Discussed below, FIGS. 3-5 illustrate actuation module 134 that may operate and/or function to open and/or close without the use of hydraulic lines. For example, without limitation, actuation module 134 may close upon a predetermined number of pressure cycles and actuation module 134 may open upon a predetermined number of pressure cycles. In examples, a pressure cycle is defined as an increase in pressure with production fluid recovery system 100. Without limitation, pressure may be applied to annulus 130, production tubing 112, and/or any combination thereof. During operations, pressure may be increased to a predetermined pressure (typically 3000 to 5000-psi), at which time the pressure in production fluid recovery system 100 may be held for about one minute to about five minutes, about two minutes to about six minutes, or about three minutes to about ten minutes. The pressure may be bled off at wellhead 108, at which time the operation may wait for about one minute to about five minutes, about two minutes to about six minutes, or about three minutes to about ten minutes. The process of increasing pressure may be repeated again for any number of suitable cycles.

The number of cycles to increase pressure and release pressure may be pre-determined and may be about one cycle to about five cycles, about two cycles to about six cycles, about three cycles to about ten cycles, about ten cycles to about fifteen cycles, about ten cycles to about twenty cycles, about ten cycles to about twenty-four cycle, or about twenty cycles to about twenty-five cycles. Without limitation, as described above, pressure cycles may increase pressure within production fluid recovery system 100 through annulus 130, production tubing 112, and/or any combination thereof. Additionally, without limitation, pressure may be released from production fluid recovery system 100 through production tubing 112.

Figure 2:
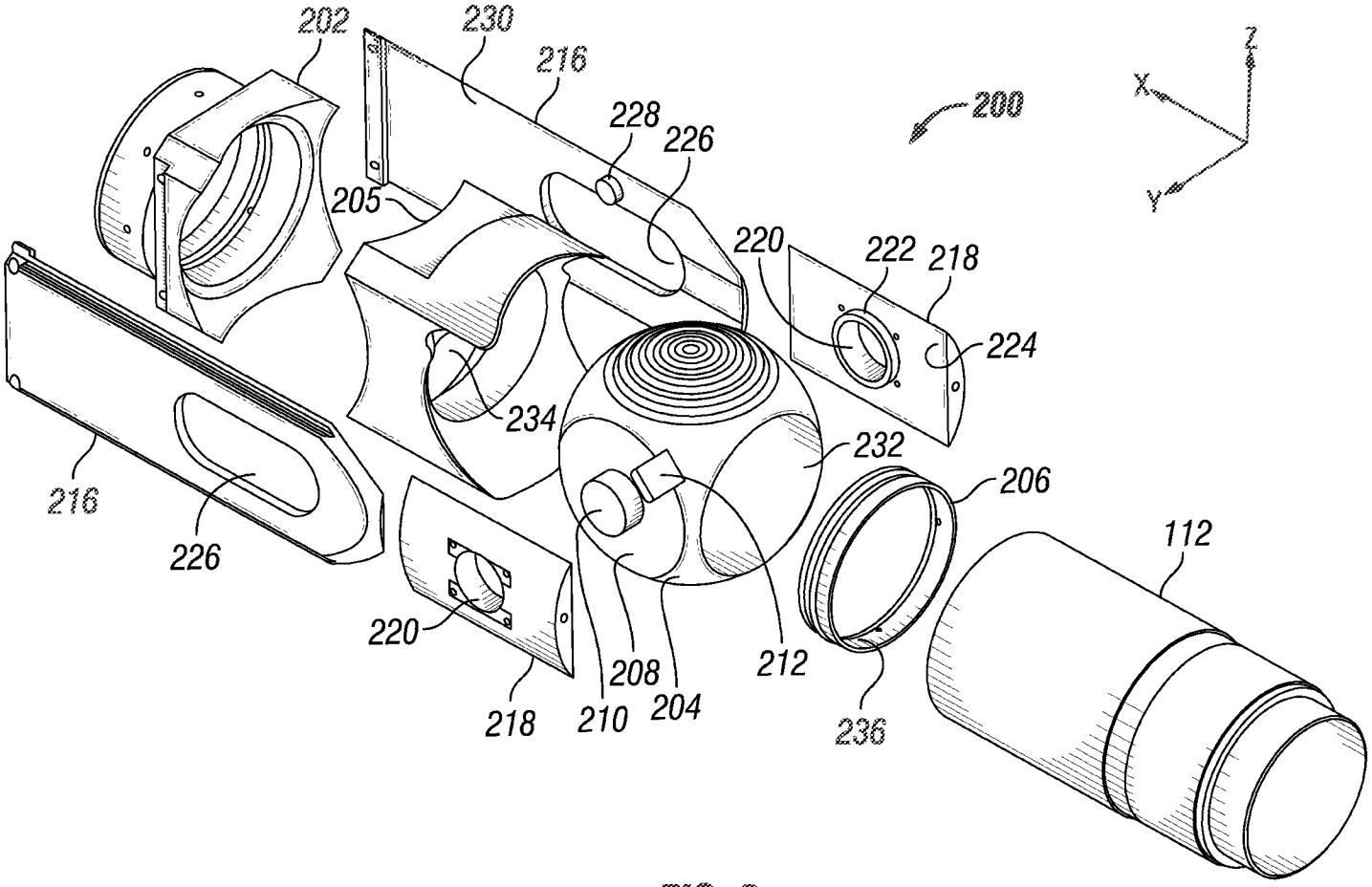
FIG. 2 illustrates a barrier valve.

As illustrated in FIG. 2, a barrier valve 200 may function to open and close from the operations of actuation module 134 (e.g., as illustrated in FIG. 1). It should be noted that while barrier valve 200 is illustrated, barrier valve 200 is only representative as a barrier mechanism. Any barrier mechanism may be used and operate and/or function with the same manner as described below. Without limitation, barrier valve 200 may be a barrier sleeve and/or any other type of barrier mechanism. During operations, actuation module 134 may sense and track pressure cycles in annulus 130. As discussed above, pressure cycles may operate actuation module 134, which may in turn operate barrier valve 200. FIG. 2 illustrates an example barrier valve 200, including a mechanism 202 for articulating ball 204 between an open position and a closed position or vice versa. As shown, ball 204 may be disposed between first housing portion 205 and second housing portion 206. In examples, production tubing 112 may be coupled to second housing portion 206. For example, second housing portion 206 may be retained to production tubing 112 by mating threads. Without limitation, ball 204 may be a truncated sphere having planar surfaces 208 formed on opposite sides of ball 204, although only one of planar surfaces 208 may be visible in FIG. 2. A cylindrical projection 210 may extend from each of the planar surfaces 208.

In examples, mechanism 202 may include a pair of arms 216 and members 218. Members 218 may include apertures 220 and a raised rim 222 extending from an inner surface 224. Each arm 216 may be disposed in a plane that is parallel with respective planar surfaces 208. Cylindrical projections 210 extend through slots 226 formed through each of arms 216 and are received into apertures 220. Raised rims 222 may also extend into slots 226. Thus, arms 216 may be sandwiched between members 218 and ball 204. Raised rims 222 may be retained in slots 226 such that arms 216 may be permitted to slide in a direction parallel to the X-axis but are prevented from moving in a direction parallel to the Z-axis. Actuation pins 228 may be provided on an inner surface 230 of each arm 216. Actuation pins 228 may be received into radial grooves 212 formed in ball 204. A bearing may be positioned between each pin 228 and radial groove 212. A bearing may also be positioned between each cylindrical projection 210 and raised rims 222.

In an open position, radial grooves 212 may be angularly positioned so that the internal bore 232 of ball 204 at least partially aligns with the first and second bore portions 234, 236 so as to provide fluid communication through barrier valve 200. In a closed position, ball 204 may be pivoted about the Y-axis until internal bore 232 of ball 204 may not provide fluid communication between the first and second bore portions 234, 236, thereby preventing fluid communication through barrier valve 200. Ball 204 may be rotated between the open and closed positions, thereby opening and closing barrier valve 200, by longitudinally displacing mechanism 202 relative to ball 204 in a direction parallel with the X-axis. As mechanism 202 is moved relative to ball 204, actuation pins 228 slide within radial grooves 212, causing ball 204 to pivot.

Barrier valve 200 may be opened or closed in any number of ways. For example, in some implementations, barrier valve 200 may be actuated by shifting a mandrel, disclosed below, in a longitudinal direction of the valve, e.g., a direction aligned with an axial direction of the first or second bore portions 234, 236, to rotate ball 204 into one of an open or closed position. In some instances, the mandrel may be shifted by application of a mechanical force transferred to the mandrel through a secondary tool. It should also be noted that barrier valve 200 may be replaced by a sliding sleeve. In other implementations, barrier valve 200 may be opened by application of fluid pressure. For example, fluid pressure may be applied to a ball 204 in a closed position. The fluid pressure may actuate a secondary mechanism that releases a biasing element, such as a spring, to pivot the ball 204 into an open position.

FIGS. 3-5 illustrates how actuation module 134 functions during downhole operations. For example, FIG. 3 illustrates actuation module 134 in a first position. As illustrated, actuation module 134 may include a housing 300 and a mandrel 302. Without limitation, actuation module 134 may be attached to production tubing 112. However, it should be noted that actuation module 134 may be attached to other tools and/or devices other than production tubing 112. As illustrated a first piston 304 and a second piston 306 may be disposed between housing 300 and mandrel 302. During operations, mandrel 302 may slide between housing 300 and production tubing 112 with the help of first piston 304 and second piston 306. Additionally, mandrel 302 may be attached to barrier valve 200 (e.g., referring to FIG. 2) which may articulate ball 204 (e.g., referring to FIG. 2), as described above. In examples, first piston 304 and second piston 306 may each be "open" and/or "closed." An "open" piston may slide freely between housing 300 and mandrel 302. A "closed" piston may be attached to mandrel 302, which may assist in moving mandrel 302. A "closed" piston may be attached to mandrel 302 with the assistance of a shear mechanism 307.

As illustrated in FIG. 3, each piston may include a retaining mechanism 308. Each retaining mechanism 308 may be designed to engage a recess 310. It should be noted that all retaining mechanisms/shear mechanisms may be changed to similar devices, such as latching devices, decouplers, and/or the like. In examples, at least one recess 310 may be disposed on mandrel 302 and housing 300. Additionally, housing 300 may also include a stop mechanism 312. Stop mechanism 312 may prevent the movement of first piston 304 and/or second piston 306 between housing 300 and mandrel 302. It should be noted that mandrel 302 may further include a vent port 314, which may allow for the flow fluid between the inside of mandrel 302 and the area between housing 300 and mandrel 302. Additionally, a first hydraulic chamber 316 and a second hydraulic chamber 318 may be formed between housing 300, mandrel 302, and/or a piston (e.g., first piston 304 and/or second piston 306).

With continued reference to FIG. 3, first piston 304 may be an "open" piston, which may allow first piston 304 to move freely between housing 300 and mandrel 302. Concurrently, second piston 306 may be in a "closed" position as second piston 306 may be attached to mandrel 302 through shear mechanism 307. Without limitation, shear mechanism 307 may be made from any suitably steel material. In examples, the steel material may be strong enough to overcome the force needed to close ball 204 (e.g., referring to FIG. 2) or a sleeve by may be about 1000-lbs (455 kg). In examples, once ball 304 or sleeve is fully closed the pressure may increase to a sufficient force in which shear mechanism 307 may shear into two pieces, disconnecting second piston 306 from mandrel 302. This may allow second piston 306 to assist in the movement of mandrel 302 between production tubing 112 and actuation module 134.

To assist in this operation, actuation module 134 may be activated by supplying a volume of fluid into second hydraulic chamber 318, which may be in a "closed" position. Moving fluid into second hydraulic chamber 318 may push second piston 306, which is attached to mandrel 302, and mandrel 302 further into housing 300. It should be noted that first piston 304, which is the "open" position, is independent on mandrel 302 and may allow mandrel 302 to slide below first piston 304 without moving. Vent port 314 may allow fluid to continue to move as mandrel 302 moves, which may prevent a hydraulic "lock."

FIG. 4 illustrates the moment mandrel 302 has travel the required length for the ball 204 (referring to FIG. 1) to be fully closed. As illustrated in FIG. 4, each retaining mechanism 308 on first piston 304 and second piston 306 have fallen into their respective recess 310 on mandrel 302 and housing 300, respectively. When each retaining mechanism 308 is seated in a recess 310, each retaining mechanism 308 prevent the further movement of mandrel 302. Additionally, retaining mechanism 308 disposed on first piston 304 may attach first piston 304 to mandrel 302 with recess 310. To open barrier valve 200, fluid is supplied to first hydraulic chamber 316, which activates first piston 304. This may move mandrel 302, as it is now attached to first piston 304, in the opposite direction of previous movement of mandrel 302 discussed in FIG. 3.

FIG. 5 illustrates first piston 304 fully extended to stop mechanism 312, which prevents further movement of first piston 304 and mandrel 302. It should be noted that second piston 306 has locked to housing 300 through retaining mechanism 308 and recess 310. Therefore, mandrel 302 may disengage from second piston 306 to move in conjunction with first piston 304. Second piston 306 may disengage from mandrel 302 when shear mechanism 307 shears into two pieces. A first piece 500 may remain in second piston 306 and a second piece 502 may remain in mandrel 302. During the moment of mandrel 302, vent port 314 may allow fluid to continue to move as mandrel 302 moves, which may prevent a hydraulic "lock." Fully extended against stop mechanism 312, the ball may be open.

In examples, at least one liquid spring cartridge or mechanism 129A and/or 129B (FIG. 3) may be used during operations. For the sake of brevity, it should be noted that the use of "liquid spring cartridge" also encompasses the use of a "liquid spring mechanism." The liquid spring cartridge may activate any downhole tool that may use a piston. For example, a first liquid spring cartridge may open the downhole tool and a second liquid spring cartridge may close the downhole tool. It should be noted that the downhole tool may be sliding side doors, mandrels, sleeves, valves, and/or the like.

During operations described above, one or more liquid spring cartridges may function to operate ball 304 (e.g., referring to FIG. 3). For example, a first liquid spring cartridge may sense pressure building within annulus 130 (e.g., referring to FIG. 3) or within production tubing 112. For each pressure cycles within annulus 130 the first liquid spring cartridge moves a predetermined increment of about 0.3 inch to about 0.5 inch (about 0.7 cm to about 1.25 cm). During operation, after a pre-determined number of pressure cycle, for example about 10 pressure cycles, the first liquid spring cartridge may free a first plug which may moves a second plug that may allow communication from annulus 130 to first piston chamber 316 and/or second piston chamber 318 (e.g., referring got FIG. 3). Once barrier valve 200 (e.g., referring to FIG. 2) is closed applying a second pressure cycles down production tubing 112 may be sensed by a second liquid spring cartridge. Activation of the second liquid spring cartridge may open ball 304 in barrier valve 200.

In examples, referring back to FIG. 3, at least one liquid spring cartridge may be sensitive to pressure increase and/or decrease in annulus 130 (e.g., referring to FIG. 1). Without limitation, the liquid spring cartridge maybe set for a predetermined number of pressure cycles which may range from about six to about ten pressure cycles, as described above. After the pre-determined number of pressure cycles have been applied, a plug schematically indicated at 17A, describe above, may be released which may allow for fluid communication between annulus 130 and first piston 304. It should be noted that while first piston 304 is described above, second piston 306 may operate and function by the same manner. Thus, increasing pressure in annulus 130 may cause first piston 304 to move, attached to causing actuation module 134 to move, which may close ball 304. To open ball 304, pressure may be applied to production tubing 112 and a second liquid spring cartridge may count pressure cycles within production tubing 112. Once the number of predetermined pressure cycles has been sensed, as described above, a plug schematically indicated at 17B on the second cartridge may be released, which may allow for fluid communication between second piston 306. Movement of second piston 306 may allow for ball 304 to move to an open position. It should be noted that if the first liquid spring cartridge senses pressure within production tubing 112, annulus 130, and/or any combination thereof, then the first liquid spring cartridge may be set to function on, for example, about ten pressure cycles and the second liquid spring cartridge (as both liquid spring cartridges would be moving) may be set, for example, to function on about pressure cycles. The systems and methods may include any of the various features of the systems and methods disclosed herein, including one or more of the following statements.

Statement 1: A system may comprise a plurality of production tubing sections; a barrier valve; and an actuation module attached to the barrier valve, wherein the actuation module is attached to one of the plurality of production tubing sections at a first end, and wherein the barrier valve is attached to a second of the plurality of production tubing sections.

Statement 2. The system of statement 1, wherein the actuation module may comprise a housing connected to the second of the plurality of production tubing sections; a mandrel connected to the barrier valve and disposed within the housing and the second of the plurality of production tubing sections; a first piston disposed between the housing and the mandrel; and a second piston disposed between the housing and the mandrel.

Statement 3. The system of statements 1 or 2, wherein the first piston further comprises at least one recess disposed within the first piston and at least one retaining mechanism disposed within the at least one recess.

Statement 4. The system of statements 1 or 2, wherein the second piston further comprises at least one recess disposed within the first piston and at least one retaining mechanism disposed within the at least one recess.

Statement 5. The system of statements 1 or 2, wherein the mandrel further comprises at least one recess disposed within the mandrel and at least one vent.

Statement 6. The system of statements 1 or 2, wherein a shear mechanism attaches the first piston or the second piston to the mandrel.

Statement 7. The system of statements 1 or 2, wherein the housing further comprises a stop mechanism disposed within an inside surface of the housing.

Statement 8. The system of statements 1 or 2, wherein the first piston, the mandrel, and the housing form a first hydraulic chamber.

Statement 9. The system of statement 8, wherein a first liquid spring cartridge is in communication with the housing and the first hydraulic chamber.

Statement 10. The system of statement 8, wherein the second piston, the mandrel, and the housing form a second hydraulic chamber.

Statement 11. The system of statement 10, wherein a second liquid spring cartridge is in communication with the housing and the second hydraulic chamber.

Statement 12. A method may comprise, attaching an actuation module to one of one or more production tubing sections, wherein a barrier valve is attached to the actuation module; disposing the actuation module, the barrier valve, and the one or more production tubing sections into an annulus, wherein the actuation module may comprises: a housing, wherein the housing is connected to the one or more production tubing sections; a mandrel, wherein the mandrel is connected to the barrier valve and disposed within the housing and the one of the one or more production tubing sections; a first piston disposed between the housing and the mandrel; and a second piston disposed between the housing and the mandrel; and moving the mandrel with the first piston or the second piston; and moving a ball within the barrier valve to a closed position.

Statement 13. The method of statement 12, further comprising: increasing pressure within the annulus; releasing pressure within the annulus; and activating the first piston or the second piston with the pressure within the annulus; and moving the mandrel with the first piston or the second position from the pressure within the annulus.

Statement 14. The method of statements 12 or 13, further comprising: increasing pressure within the one or more production tubing; releasing pressure within the one or more production tubing; activating the first piston or the second piston with the pressure within the one or more production tubing; and moving the mandrel with the first piston or the second piston from the pressure within the one or more production tubing.

Statement 15. The method of statements 12-14, wherein the first piston or the second piston is connected to the mandrel with a shear mechanism.

Statement 16. The method of statements 12-15, wherein the first piston, the mandrel, and the housing form a first hydraulic chamber.

Statement 17. The method of statement 16, wherein a first liquid spring cartridge is in communication with the housing and the first hydraulic chamber.

Statement 18. The method of statement 17, further comprising activating the first liquid spring cartridge with the pressure from the annulus.

Statement 19. The method of statement 16, wherein the second piston, the mandrel, and the housing form a second hydraulic chamber.

Statement 20. The method of statement 19, wherein a second liquid spring cartridge is attached to the housing and the second hydraulic chamber and wherein the second liquid spring cartridge is activated with the pressure from the one or more production tubing.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A system for remotely opening and closing a barrier valve, the system comprising:

a production tubing extending into a wellbore;

a barrier valve to control flow of production fluid through the production tubing;

an actuation module including a housing, a mandrel moveably positioned within the housing to operate the barrier valve, first and second pistons between the mandrel and the housing, a first chamber defined between the mandrel, the housing, and the first piston, a second chamber defined between the mandrel, the housing, and the second piston, and one or more retaining mechanisms for engaging one or both of the first piston and the second piston with the mandrel or housing; and a fluid supply located downhole to supply hydraulic fluid to the first chamber in response to a first predetermined number of pressure cycles to shift the mandrel in a first direction and to supply hydraulic fluid to the second chamber in response to a second predetermined number of pressure cycles to shift the mandrel in a second direction, wherein the second piston is initially coupled to the mandrel to move the mandrel with respect to the housing in the second direction in response to supplying the hydraulic fluid to the second chamber, and wherein the one or more retaining mechanisms retains the first piston to the mandrel in response to moving the mandrel in the second direction, to then move the mandrel with respect to the housing back in the first direction in response to supplying the hydraulic fluid to the first chamber.

2. The system of claim 1, wherein the first and second predetermined number of pressure cycles are applied to an annulus about the production tubing.

3. The system of claim 2, wherein the first predetermined number of pressure cycles are applied to close the barrier valve and, with the barrier valve closed, the second predetermined number of pressure cycles are applied to open the barrier valve.

4. The system of claim 3, wherein fluid pressure applied to the annulus actuates a secondary mechanism that releases a biasing element to open the barrier valve.

5. The system of claim 1, further comprising:

a first liquid spring cartridge responsive to the first predetermined number of pressure cycles to supply the hydraulic fluid from the fluid supply to the first chamber; and a second liquid spring cartridge responsive to the second predetermined number of pressure cycles to supply the hydraulic fluid from the fluid supply to the second chamber.

6. The system of claim 1, wherein the mandrel may also be shifted by application of a mechanical force transferred to the mandrel through a secondary tool.

7. The method of claim 1, further comprising:

initially retaining the second piston to the mandrel with a shear member to shift the mandrel in the second direction in response to supplying the hydraulic fluid to the second chamber;

retaining the first piston to the mandrel in response to shifting the mandrel in the second direction; and then shifting the mandrel back in the first direction in response to supplying the hydraulic fluid to the first chamber.

8. The method of claim 1, wherein shifting the mandrel back in the first direction shears the shear member.

9. A system for remotely opening and closing a barrier valve, the system comprising:

a production tubing extending into a wellbore;

a barrier valve to control flow of production fluid through the production tubing;

an actuation module including a housing, a mandrel moveably positioned within the housing to operate the barrier valve, first and second pistons between the mandrel and the housing, a first chamber defined between the mandrel, the housing, and the first piston, a second chamber defined between the mandrel, the housing, and the second piston;

a fluid supply located downhole to supply hydraulic fluid to the first chamber in response to a first predetermined number of pressure cycles to shift the mandrel in a first direction and to supply hydraulic fluid to the second chamber in response to a second predetermined number of pressure cycles to shift the mandrel in a second direction;

a first liquid spring cartridge responsive to the first predetermined number of pressure cycles to supply the hydraulic fluid from the fluid supply to the first chamber; and a second liquid spring cartridge responsive to the second predetermined number of pressure cycles to supply the hydraulic fluid from the fluid supply to the second chamber, wherein the first liquid spring cartridge, in response to the first predetermined number of pressure cycles, frees a plug that allows fluid communication from the annulus to the first piston chamber.

10. The system of claim 9, wherein the first liquid spring cartridge allows communication of the hydraulic fluid from the fluid supply to the first chamber through the annulus in response to the first predetermined number of pressure cycles.

11. A system for remotely opening and closing a barrier valve, the system comprising, the system comprising:

a production tubing extending into a wellbore;

a barrier valve to control flow of production fluid through the production tubing;

an actuation module including a housing, a mandrel moveably positioned within the housing to operate the barrier valve, first and second pistons between the mandrel and the housing, a first chamber defined between the mandrel, the housing, and the first piston, a second chamber defined between the mandrel, the housing, and the second piston;

a fluid supply located downhole to supply hydraulic fluid to the first chamber in response to a first predetermined number of pressure cycles to shift the mandrel in a first direction and to supply hydraulic fluid to the second chamber in response to a second predetermined number of pressure cycles to shift the mandrel in a second direction;

a first liquid spring cartridge responsive to the first predetermined number of pressure cycles to supply the hydraulic fluid from the fluid supply to the first chamber; and a second liquid spring cartridge responsive to the second predetermined number of pressure cycles to supply the hydraulic fluid from the fluid supply to the second chamber, wherein the second liquid spring cartridge, in response to the second predetermined number of pressure cycles, frees a plug that allows fluid communication to the second piston chamber.

12. The system of claim 9, wherein the actuation module further comprises one or more retaining mechanisms for engaging one or both of the first piston and the second piston with the mandrel or housing.

13. The system of claim 12, wherein the second piston is initially coupled to the mandrel to move the mandrel with respect to the housing in the second direction in response to supplying the hydraulic fluid to the second chamber.

14. The system of claim 11, wherein the second liquid spring cartridge allows communication of the hydraulic fluid from the fluid supply to the second chamber from the production tubing in response to the second predetermined number of pressure cycles.

15. A method for remotely opening and closing a barrier valve, the method comprising:

applying a first predetermined number of pressure cycles downhole to a production tubing, an annulus about the production tubing, or combination thereof;

sensing the first predetermined number of pressure cycles downhole and supplying hydraulic fluid to a first chamber of an actuation module to shift a mandrel in a first direction to remotely operate the barrier valve;

applying a second predetermined number of pressure cycles downhole to the production tubing, the annulus about the production tubing, or combination thereof; and sensing the second predetermined number of pressure cycles downhole and supplying hydraulic fluid to a second chamber of the actuation module to shift the mandrel in a second direction to remotely operate the barrier valve;

wherein one of the first and second directions is to open the barrier valve and the other of the first and second directions is to close the barrier valve;

initially retaining the second piston to the mandrel with a shear member to shift the mandrel in the second direction in response to supplying the hydraulic fluid to the second chamber;

retaining the first piston to the mandrel in response to shifting the mandrel in the second direction; and then shifting the mandrel back in the first direction in response to supplying the hydraulic fluid to the first chamber.

16. The method of claim 15, wherein the first predetermined number of pressure cycles is applied to the annulus to close the barrier valve and the second predetermined number of pressure cycles is applied to the production tubing with the barrier valve closed to subsequently open the barrier valve.

17. The method of claim 15, wherein shifting the mandrel back in the first direction shears the shear member.

18. The method of claim 15, further comprising:

for each pressure cycle of the first predetermined number of pressure cycles, moving a first liquid spring cartridge a predetermined increment; and after the first predetermined number of pressure cycles, using the first liquid spring cartridge to allow communication from the annulus to the first chamber.

19. The method of claim 18, further comprising:

for each pressure cycle of the second predetermined number of pressure cycles, moving a second liquid spring cartridge a predetermined increment; and after the second predetermined number of pressure cycles, using the second liquid spring cartridge to allow communication of the hydraulic fluid to the second chamber.

20. The method of claim 15, further comprising:

additionally shifting the mandrel any number of times by applying a mechanical force to the mandrel through a secondary tool.

* * * * *